US005103661A

United States Patent [19]

Fann et al.

[11] Patent Number: 5,103,661

[45] Date of Patent: Apr. 14, 1992

[54] MECHANICAL CODE LOCK

[75] Inventors: Yaw-Shin Fann; Ming-Shyang Chiou, both of Chia-Yi, Taiwan

[73] Assignee: Tong Lung Metal Industry Co., Ltd., Chia-Yi, Taiwan

[21] Appl. No.: 613,169

[22] Filed: Nov. 13, 1990

[51] Int. Cl.[5] ..... E05B 27/00

[52] U.S. Cl. ..... 70/360; 70/384; 70/409; 70/411

[58] Field of Search ..... 70/360, 361, 358, 395, 70/401, 409, 411, 382-385

[56] References Cited

U.S. PATENT DOCUMENTS

| | | | |
|---|---|---|---|
| 3,877,267 | 4/1975 | Harris | 70/395 |
| 4,377,082 | 3/1983 | Wolter | 70/409 |
| 4,667,495 | 5/1987 | Girard | 70/409 |
| 4,712,402 | 11/1987 | Monahan | 70/383 |
| 4,741,188 | 5/1988 | Smith | 70/383 |

FOREIGN PATENT DOCUMENTS

| | | | |
|---|---|---|---|
| 2492872 | 4/1982 | France | 70/409 |

*Primary Examiner*—Renee S. Luebke
*Assistant Examiner*—Suzanne L. Dino

[57] ABSTRACT

A code lock includes an intermediate bead seat, upper and lower bead seats, all of which are provided with tumbler bead holes receiving tumbler beads. The upper and lower bead seats are slidable relative to the intermediate bead seat between a normal position in which the bead holes of the upper and lower bead seats are aligned with first bead holes of the intermediate bead seat and a resetting position in which the bead holes thereof are aligned with second bead holes of the intermediate bead seat. The combination of the tumbler beads can be changed by using a code key which selectively transfers some tumbler beads from the first to the second bead holes.

18 Claims, 14 Drawing Sheets

MECHANICAL CODE LOCK

BACKGROUND OF THE INVENTION

1. Field of The Prior Art

This invention relates to a mechanical code lock, and particularly to a mechanical code lock having tumbler beads which can be changed to different combinations by selectively transferring some beads from one group to another group of tumbler holes by means of a code key.

2. Brief Description of Related Prior Art

Mechanical code locks whose combinations can be changed by using a code card are known in the art. For example, U.S. Pat. No. 4,149,394 discloses a mechanical lock having tumbler pins and tumbler balls which can be changed into various combinations by using different code cards. The lock is unlocked by using a key card which is operative only when the code card is present in the lock.

SUMMARY OF THE INVENTION

An object of the invention is to provide a mechanical code lock whose combination can be changed by using a code key and which can be unlocked by an operating key, the operating key being capable of operating the lock without the need to use the code key simultaneously.

According to the present invention, a code lock comprises: a tabular intermediate bead seat having alternating first and second intermediate bead holes; a tabular upper bead seat slideably lying above the intermediate bead seat and having upper bead holes; a tabular lower bead seat slideably disposed beneath the intermediate bead seat and having lower bead holes; a group of tumbler beads for locking and unlocking the upper and lower bead seats against movement relative to the intermediate bead seat, the group including upper tumbler beads provided in the upper bead holes, lower tumbler heads provided in the lower bead holes, first intermediate tumbler beads received in the first intermediate bead holes, second intermediate tumbler beads received in the second intermediate bead holes, and transfer beads originally received in the second intermediate bead holes below the first intermediate tumbler beads. The upper and lower bead seats are associated to simultaneously move between a normal position in which the first intermediate bead holes are aligned with said upper and lower bead holes, and a resetting position in which the second intermediate bead holes are aligned with the upper and lower bead holes.

The upper and lower tumbler beads, and the first intermediate tumbler are put into a combination by selectively transferring the transfer beads from respective second intermediate bead holes to respective first intermediate bead holes. The transfer beads can be selectively discharged from the second intermediate bead holes into the lower bead holes by means of the platelike code key when the upper and lower bead seats are in the resetting position. The transfer beads discharged thereby are moved to the first intermediate bead holes when the upper and lower bead seats are moved to the normal position.

The present exemplary preferred embodiment will be described in detail with reference to the accompanying drawings, in which:

DETAILED DESCRIPTION OF THE PREFERRED EMBODIMENT

Figure 1:
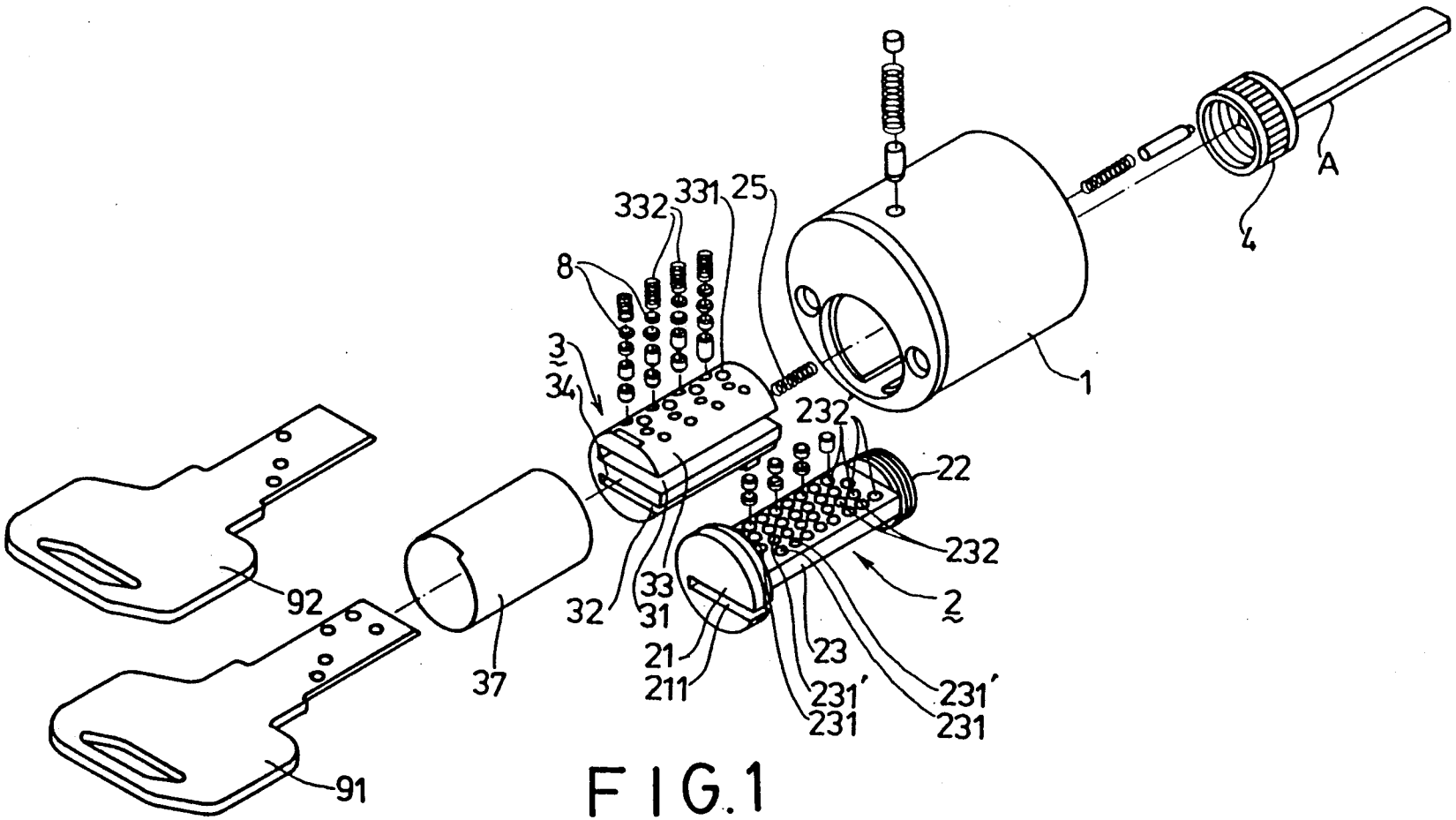
FIG. 1 is a perspective view of a first embodiment of the mechanical code lock of the present invention.
Figure 2:
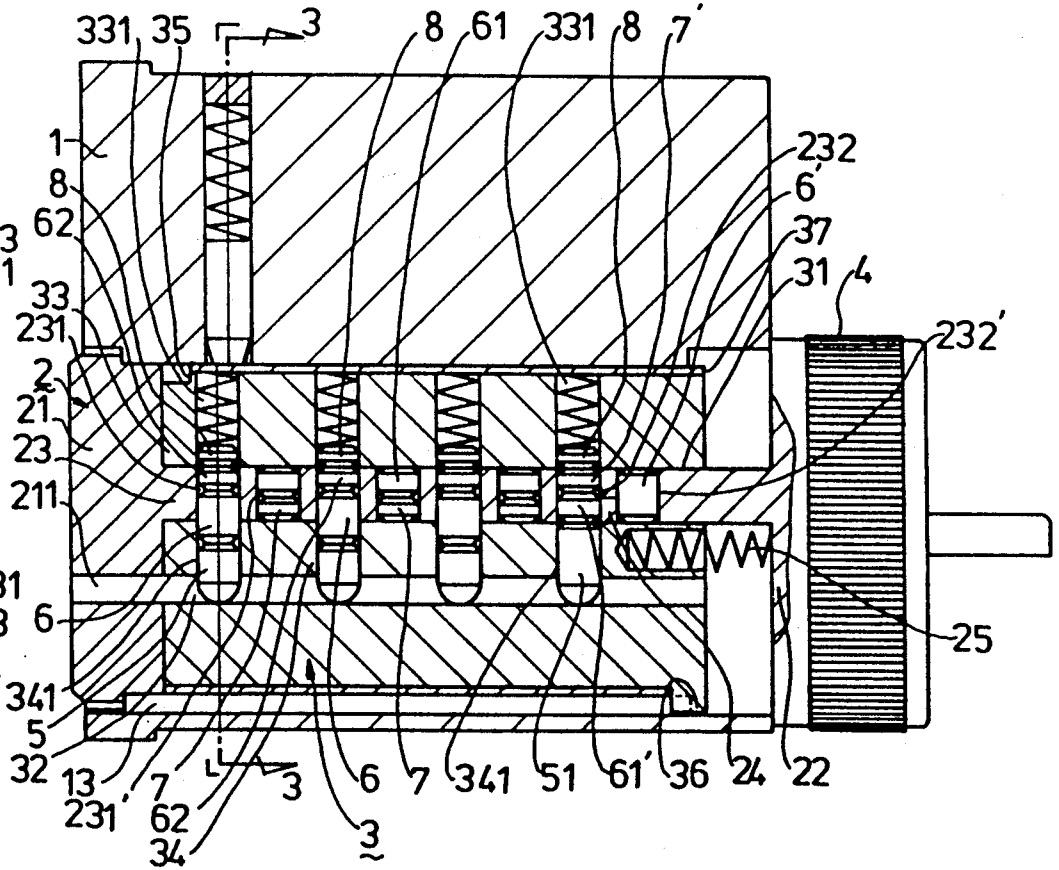
FIG. 2 is a sectional view of the lock of FIG. 1 in which tumbler beads are not coded.
Figure 3:
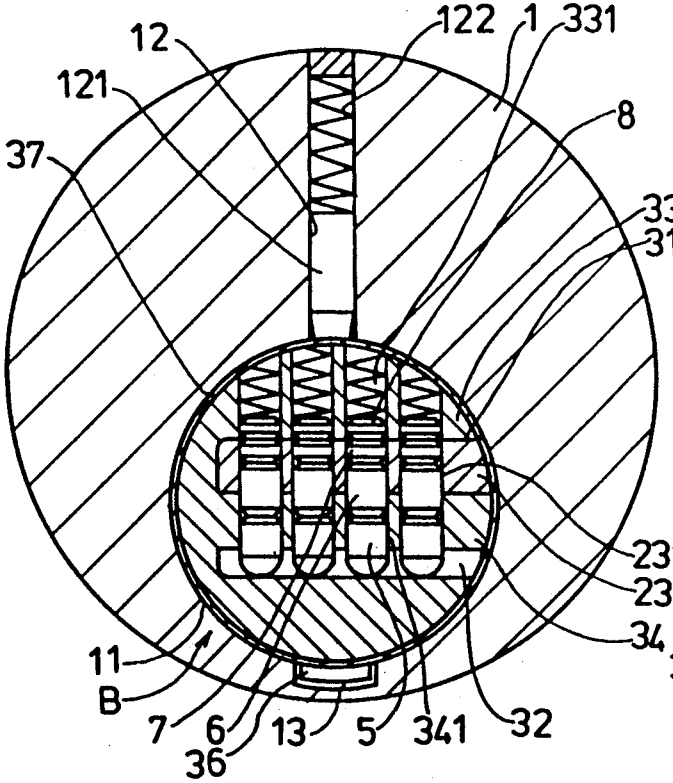
FIG. 3 is a sectional view taken along line 3—3 of FIG. 2.

Referring to FIGS. 1 to 3, a code lock embodying the present invention is shown, having an outer cylindrical housing 1 formed with a cylindrical bore 11, an axial groove 13 and a radial bore 12. The radial bore 12 receives a spring 122 and a locking pin 121. The cylindrical bore 11 receives a rotary plug assembly B constituted by a slide body 3 and a non-slidable body 2.

The non-slidable body 2 has an axial tabular bead seat 23 and two circular disk members 21 and 22. A key hole 211 is formed in the front circular disk member 21. The slide body 3 is cylindrical and is provided a tabular key bore 32 and a tabular groove 31 both of which extend chordally and axially and open at one side of the periphery of the slide body. A tabular upper bead seat 33 is formed above the axial groove 31 and a tabular lower bead seat 34 is formed between the key bore 32 and the axial groove 31. The axial groove 31 receives the intermediate tabular bead seat 23 of the non-slidable body 2. A compression spring 25 is disposed between the rear circular disk member 22 and the slide body 3.

Normally, the slide body 2 is biased by the spring 25 as shown in FIG. 3. An upper tumbler bead 8 and a spring 332 are provided in each tumbler hole 331 of the upper bead seat 33. A lower tumbler bead 5 is provided in each tumbler hole 341 of the lower bead seat 34. The front part of the intermediate bead seat 23 has axial rows of alternating first and second bead holes 231 and 231'. Each first tumbler hole 231 receives first tumbler beads 6 and 62. Each second tumbler hole 231' originally receives a second tumbler bead 61 and a transfer bead 7. The length of each tumbler bead 6 is equal to that of each bead hole 231. The sum of the lengths of the bead 61 and the transfer bead 7 is equal to the length of the bead hole 231'. The length of each lower bead 5 is equal to that of each lower bead hole 341.

The rear part of the intermediate bead seat 23 has third and fourth bead holes 232 and 232'. Each third bead hole 232 receives third beads 61' and 7'. Each fourth bead hole 232' receives a bead 6'. A shallow recess 24 intercommunicates each pair of third and fourth bead holes 232 and 232'. A lower tumbler 51 is disposed in each rearmost one of each row of the lower bead holes 341.

Figure 9:
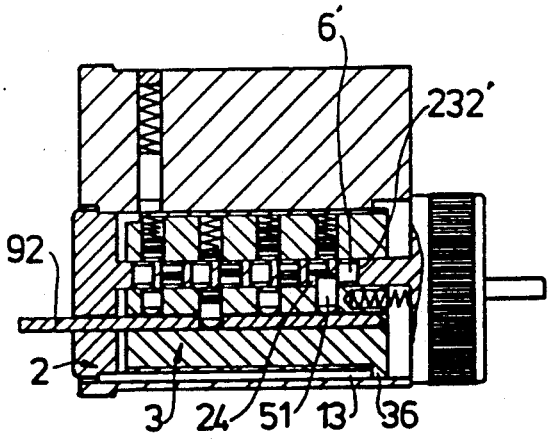
FIG. 9 shows the same section as FIG. 2 but with with the operating key in an unlocking position.

The slide body 3 and the non-slidable body 2 are fitted in an inner cylindrical shell 37 which in turn is rotatably placed in the outer housing 1. The rear circular disk 22 of the body 2 is threadedly connected to a bolt actuating member 4 by means of a nut 4. The plug assembly B is rotatable relative to the outer housing 1. As shown in FIG. 3, when the slide body 3 is biased forward by the spring 25, a bottom projection 36 provided at the rear end the slide body projects into the axial groove 13 of the outer casing 1, thereby locking the plug assembly against rotation. However, when the slide body 3 is moved rearward to a first rear position (FIG. 9) by means of a key card, and to a second rear position (FIG. 4) by means of a code card, the bottom projection 36 moves rearward and is released from the axial groove 13 of the outer housing 1 thereby enabling the plug assembly to rotate.

The plug assembly B is locked against rotation when the slide body 3 is locked against rearward movement by the tumbler beads 6 which project from the bead holes 231 into the upper or lower bead holes 331 or 341.

The tumbler beads 5, 6,8 can be coded variably by selectively transferring transfer beads 7 from the bead holes 231' to bead holes 231. The code can be reset by rearranging the transfer beads 7 using different code cards. Different key cards 92 corresponding to the code cards 91 are provided to unlock the lock.

When the code of the lock is to be reset with a new code card, the prior code should be cleared by using a prior code card and a plain card, that is to say, the transfer beads 7 previously transferred to the bead holes 231 should be replaced in their original bead holes 231' as shown in FIGS. 2 and 3. How to clear the code will be described hereinafter.

Figure 5:
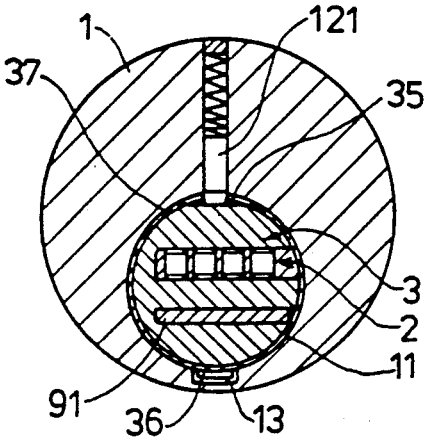
FIG. 5 is a sectional view taken along line 5—5 of FIG. 4 in which the plug assembly is not rotated.
Figure 4:
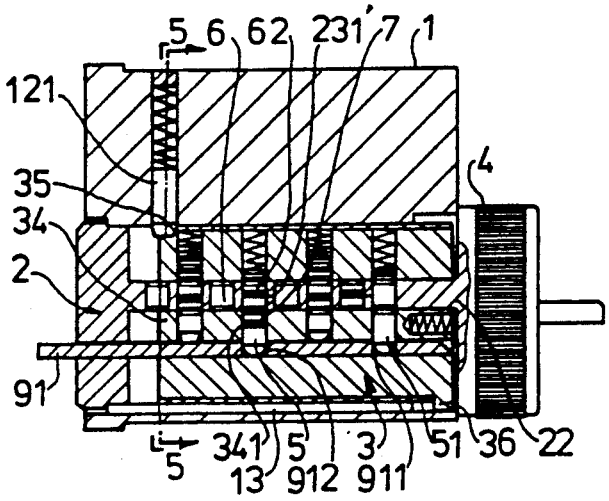
FIG. 4 shows the same section as FIG. 2, but with upper and lower bead seats moved to the second rear position.
Figure 6:
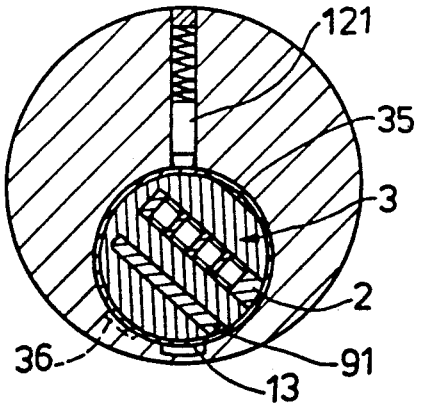
FIG. 6 shows the same section as FIG. 5 but with the plug assembly being rotated.
Figure 7:
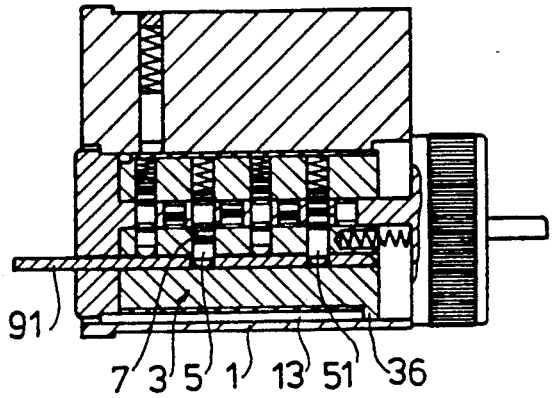
FIG. 7 shows the same section as FIG. 2 but with a code key inserted.

The lock in the position shown in FIG. 3 can be reset by inserting a code card 91 in the key bore 32 and pushing the code card rearward as shown in FIGS. 4 and 5. The slide body 3 is moved to its second rear position so that the locking pin 121 engages a front notch 35 formed at the front end of the slide body 3 and that the projection 36 is released from the axial groove 13. The upper and lower bead holes 331 and 341 which are aligned with the second bead holes 231 are moved rearward to be aligned with second intermediate bead holes 231'. The code card 91 has code holes 912 and non-code holes 911. The code holes 912 receive the lower ends of some lower tumbler beads 5. Since said lower tumbler bead 5 are lowered, the transfer beads 7 resting thereon are discharged into the respective lower bead holes 341, and the respective tumbler beads 62 are lowered into the second intermediate bead holes 231'. The non-code holes 911 receive the lower ends of some lower beads 51. Therefore, all of the beads are flush with the interface between the intermediate bead seat 23 and the upper or lower bead seat 33 or 34. When the slide body 3 is turned clockwise by an angle shown in FIG. 6, the locking pin 121 which locks the slide body 3 against forward movement is released from the notch 35. The slide body 3 is then turned counterclockwise to let the projection 35 to be aligned with the axial groove 13, thereby allowing the slide body 3 to move forward by the spring 25 and to take the discharged transfer beads 7 toward the first bead holes 231, as shown in FIG. 7.

To clear a code, the corresponding code card must be first re-inserted in the key bore to move the upper and lower bead seats into their second rear position and to move the transfer beads 7 toward the respective tumbler holes 231'. Then, a plain plate is inserted to raise and return the transfer beads to the respective tumbler holes 231' and to let the slide body 3 move forward in a manner described above. The beads shown in FIG. 3 are not coded.

Figure 8:
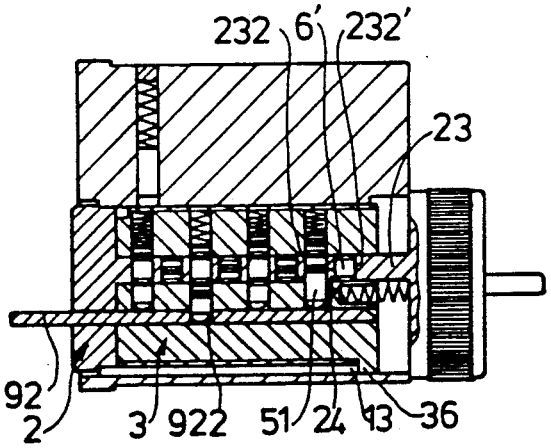
FIG. 8 shows the same section as FIG. 2 but with an operating key inserted.

Referring to FIG. 8, the lock is unlocked by a key card 92 having key holes 922 arranged in a pattern corresponding to the code holes 912 of the code card 91. However, the key card 92 is not provided with any holes corresponding to the non-code holes 911 of the code card 91 so that the beads 51 projects into the respective bead holes 232. When the slide body 3 is moved rearward, the projecting parts of the beads 51 slide along the shallow recesses 24 and are stopped by the beads 6'. As a result, the slide body 3 cannot be moved to the second rear position while it can be moved to the first rear position that permits the projection 36 to be released from the axial groove 13. The slide body 3 in this situation can be rotated for the unlocking operation but does not permit the resetting operation.

Figure 10:
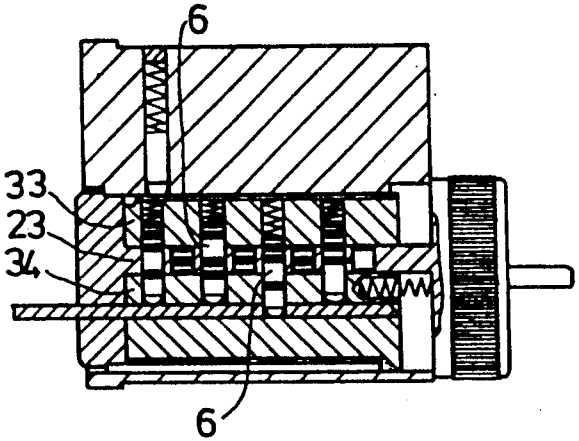
FIG. 10 shows the same section as FIG. 2 but with a wrong key inserted.

Referring to FIG. 10, when a wrong key card is inserted into the key bore of the lock, the tumbler beads 6 project into the upper and lower bead holes 331 and 341, thereby locking the slide body 2 against rearward movement.

Figure 11:
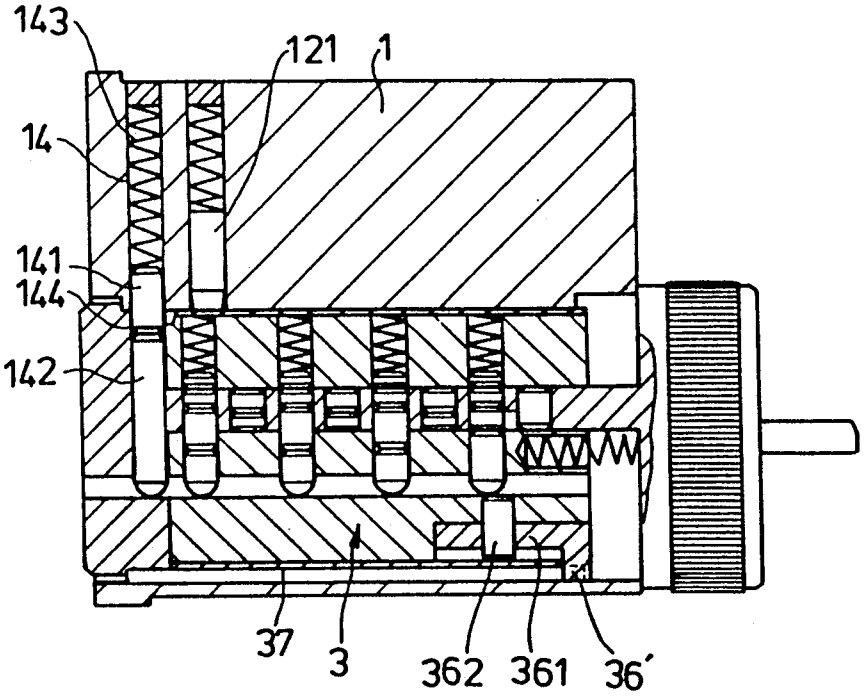
FIG. 11 is a sectional view which shows an alternative arrangement for the bottom projection of the slide body of the lock of FIG. 1.

Referring to FIG. 11, an alternative projection 36' is provided on the slide body 3 by attaching a angled piece 361' to the slide body by means of a fastener 362. The outer housing 1 is further provided with a second radial locking pin 141 together with a compression spring 143 in a radial hole 14. The locking pin 141 is aligned with a third locking pin 142 which is provided in a radial bore 144 of the slide body 3. The locking pins 141 and 142 can lock the slide body 3 against rotation.

Figure 12:
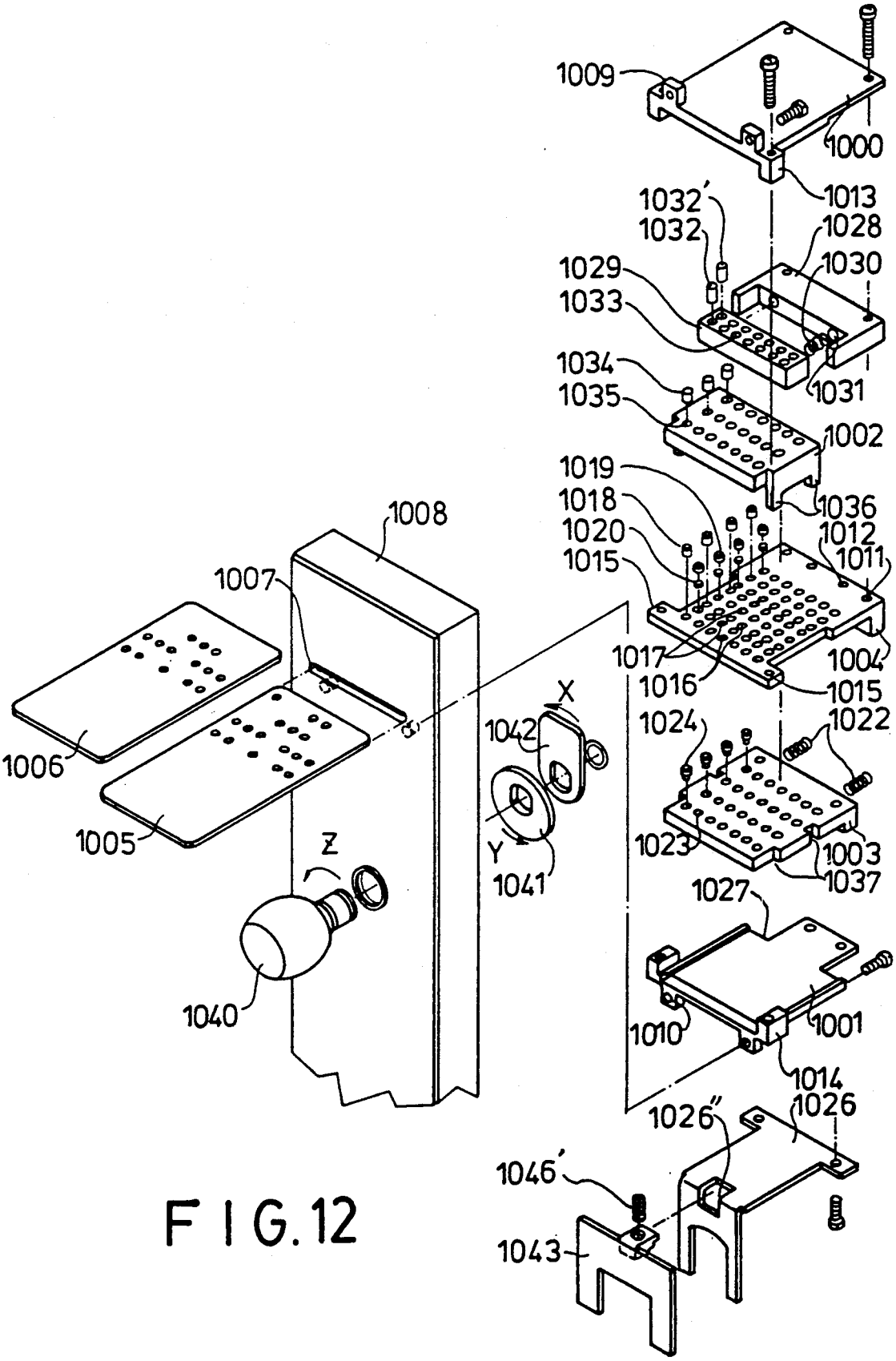
FIG. 12 is an exploded view of a second embodiment of the present invention.
Figure 13:
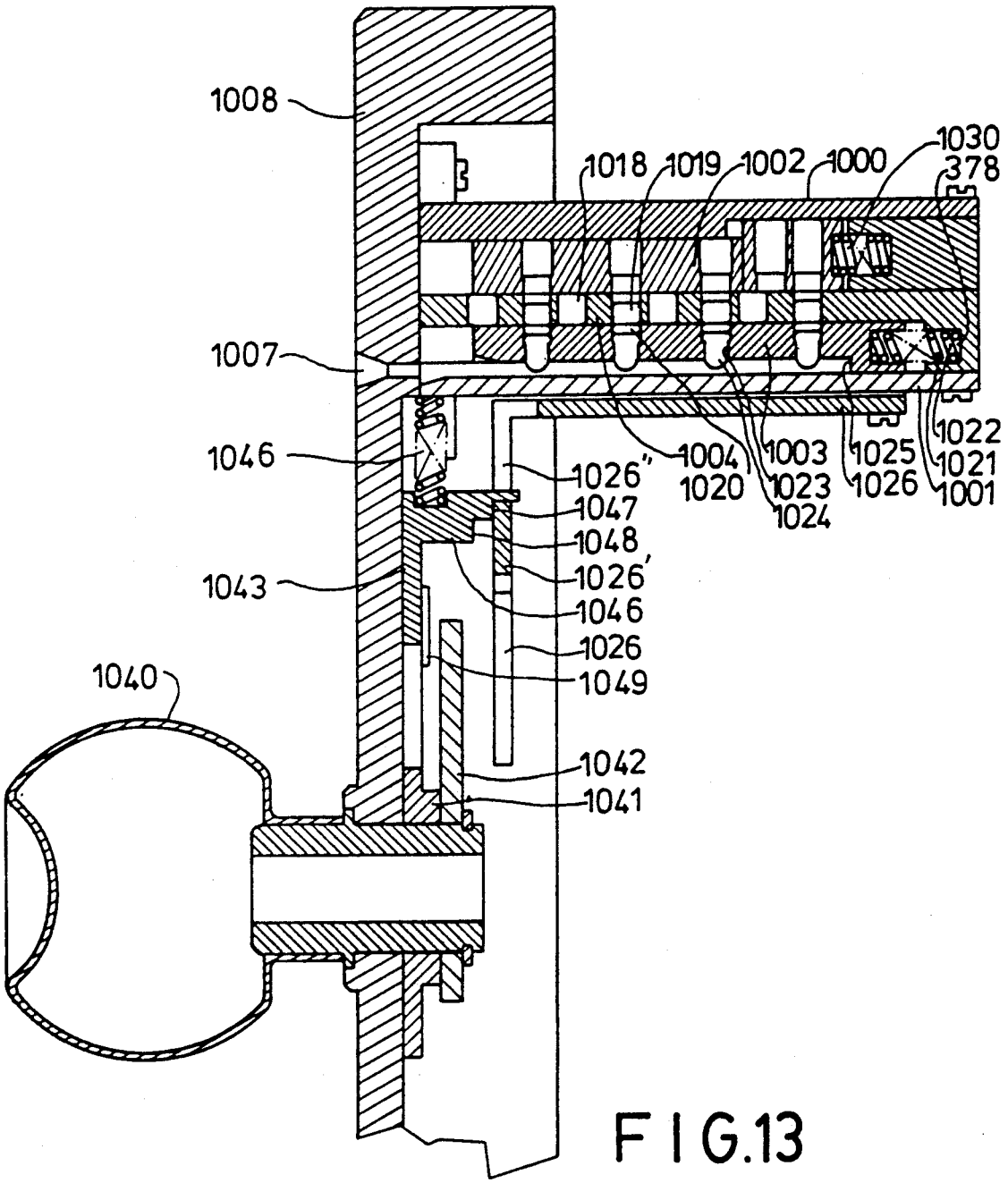
FIG. 13 is a sectional view of the lock of FIG. 12 in which the tumbler beads are not coded.

Referring to FIGS. 12 and 13, a second embodiment of the present invention includes a casing 1008 incorporating two horizontal holding plates 1000 and 1001 to clamp therebetween an upper bead seat 1002, a lower bead seat 1003, and an intermediate bead seat 1004. A code card 1005 and a key card 1006 are used to be inserted into a key bore 1007 formed in the casing.

The front ends of the holding plate 1000 and 1001 are screwed to a mounting casing 1008 by means of their front lugs 1009 and 1010. The rear end of the holding plate 1000 is screwed to the intermediate bead seat 1004 at 1011. The rear end of the holding plate 1001 is screwed to the intermediate bead seat 1004 at 1012. Downward projections 1013 of the holding plate 1000 and upward projections 1014 of the holding plate 1001 are screwed to lugs 1015 of the intermediate bead seat 1004.

The intermediate bead seat 1004 is provided with alternating rows of bead holes 1016 and 1017. The holes 1016 receive long magnetic tumbler beads 1018, and the holes 1017 receive short magnetic tumbler beads 1019 and transfer beads 1020. The downward flange of the bead seat 1004 is provided with two spring holes 378 to receive springs 1022.

The lower bead seat member 1003 is provided between the intermediate bead seat 1004 and the holding plate 1001. Stepped bead holes 1023 are provided in the lower bead seat 1003 to receive tumbler beads 1024. The bottom side of the lower bead seat 1003 is recessed to define the key bore 1007 together with the lower holding plate 1001 as well as to form a key bearing face 1025. The rear side of the lower bead seat 1003 is also recessed to cooperatively receive the springs 1022. The springs 50 normally urge the lower bead seat 1003 to move forward. An L-shaped locking plate 1026 is disposed below the holding plate 1001 and connected to the lower bead seat 1003. The holding plate 1001 is notched at 1027 to permit connection of the lower bead seat 1003 and the locking plate 1026. The upper side of the holding plate 1001 is also recessed to define the key bore 1007.

A stop plate 1028 is provided between and screwed to the intermediate bead seat 1002 and the holding plate 1000. The front end of the stop plate 1028 has two forward flanges to confine a space to receive a locking bead seat 1029. Springs 1030 are received in holes 1031 of the stop plate 1028 to urge the locking bead seat 1029. Long magnetic tumbler beads 1032 and 1032' are provided in holes 1033 of the locking bead seat 1029.

The upper bead seat 1002 is provided with bead holes 1034 to receive short magnetic tumbler beads 1035. Downward legs 1036 of the upper bead seat 1002 are fitted in notches 1037 formed at two sides of the lower bead seat 1003.

The function and configuration of the tumbler holes 1023, 1016, 1017, and 1035, and the beads 1024, 1018, 1019, 1020, and 1034 are similar to those of the tumbler holes 341, 231, 231' and 331, and the beads 5, 6, 61 and 7 of the previous embodiment except that the beads of the second embodiment are biased downward by magnetic repulsion.

Figure 14:
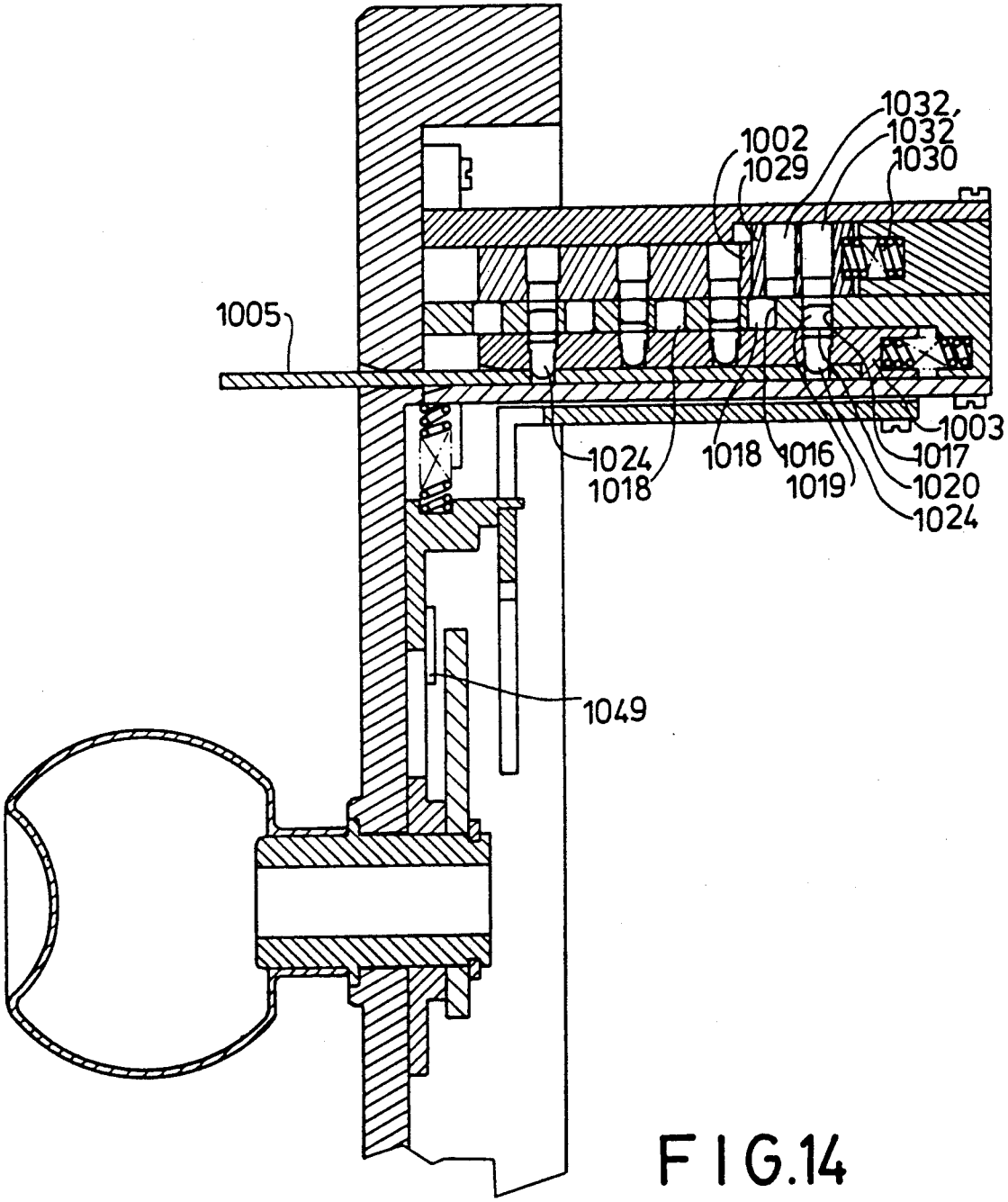
FIG. 14 shows the same section as FIG. 13 but with a code key inserted.
Figure 15:
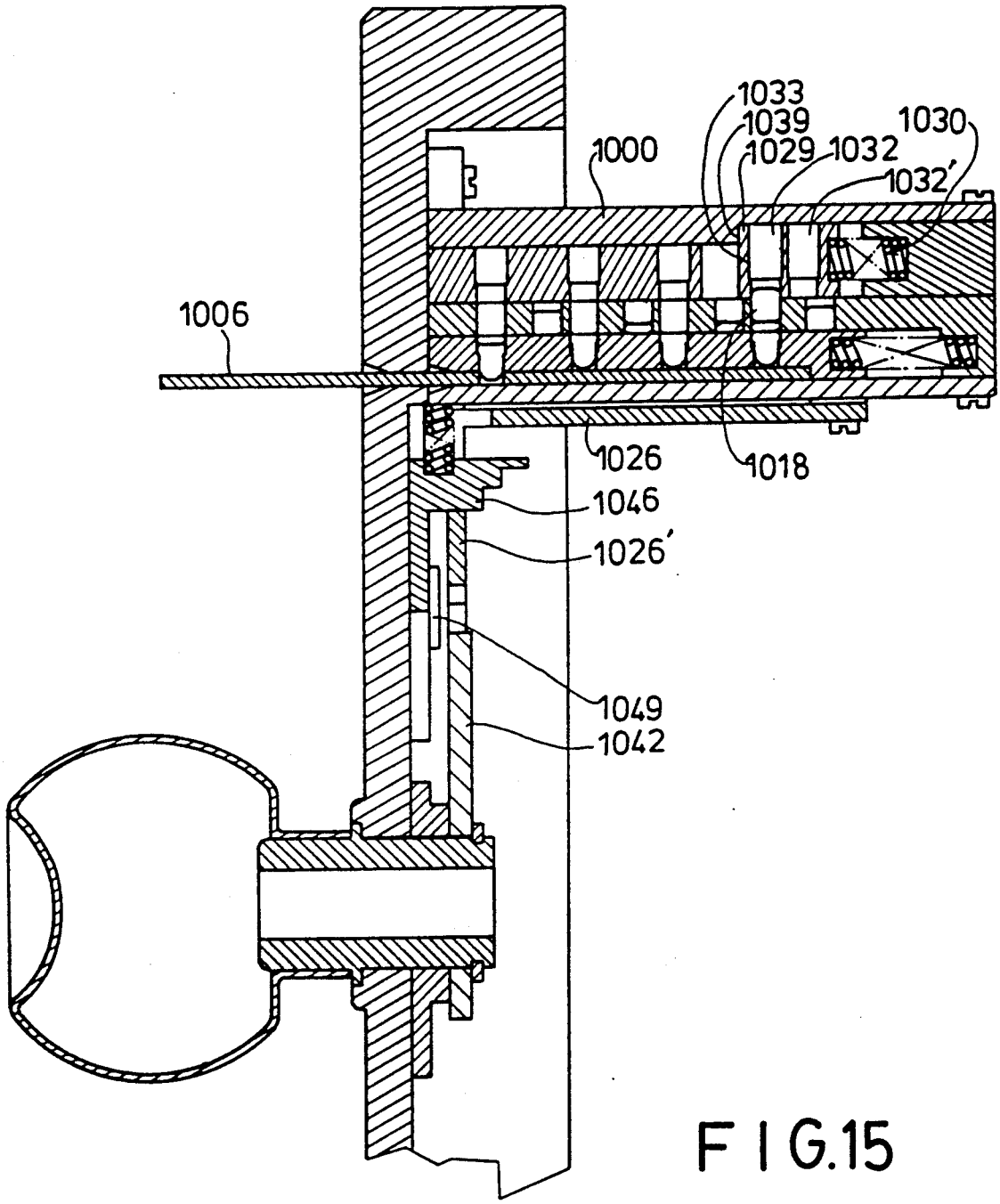
FIG. 15 shows the same section as FIG. 13 but with an operating key inserted.

Like the previous embodiment, the upper and lower bead seats 1002 and 1003 can be moved rearward to a second rear position shown in FIG. 14 by means of the code card 1005 and to a first rear position shown in FIG. 15 by means of the key card 1006. The locking bead seat 1029 prevents the upper and lower bead seats 1002 and 1003 from moving to the second rear position when the key card is used.

The locking bead seat 1029 is normally biased by the spring 1030 so that the locking bead seat 1029 abuts against a shoulder 1039 of the upper holding plate 1000 as shown in FIG. 15. When the code card 1005 is inserted into the key bore as shown in FIG. 14, the upper and lower bead seats 1002 and 1003 are moved to their second rear position because none of the tumbler beads 1018 engage the upper and lower bead seats 1002 and 1003. In this situation, the locking bead seat 1029 is moved rearward against the force of the springs 1030 by the upper bead seat 1002.

Figure 16:
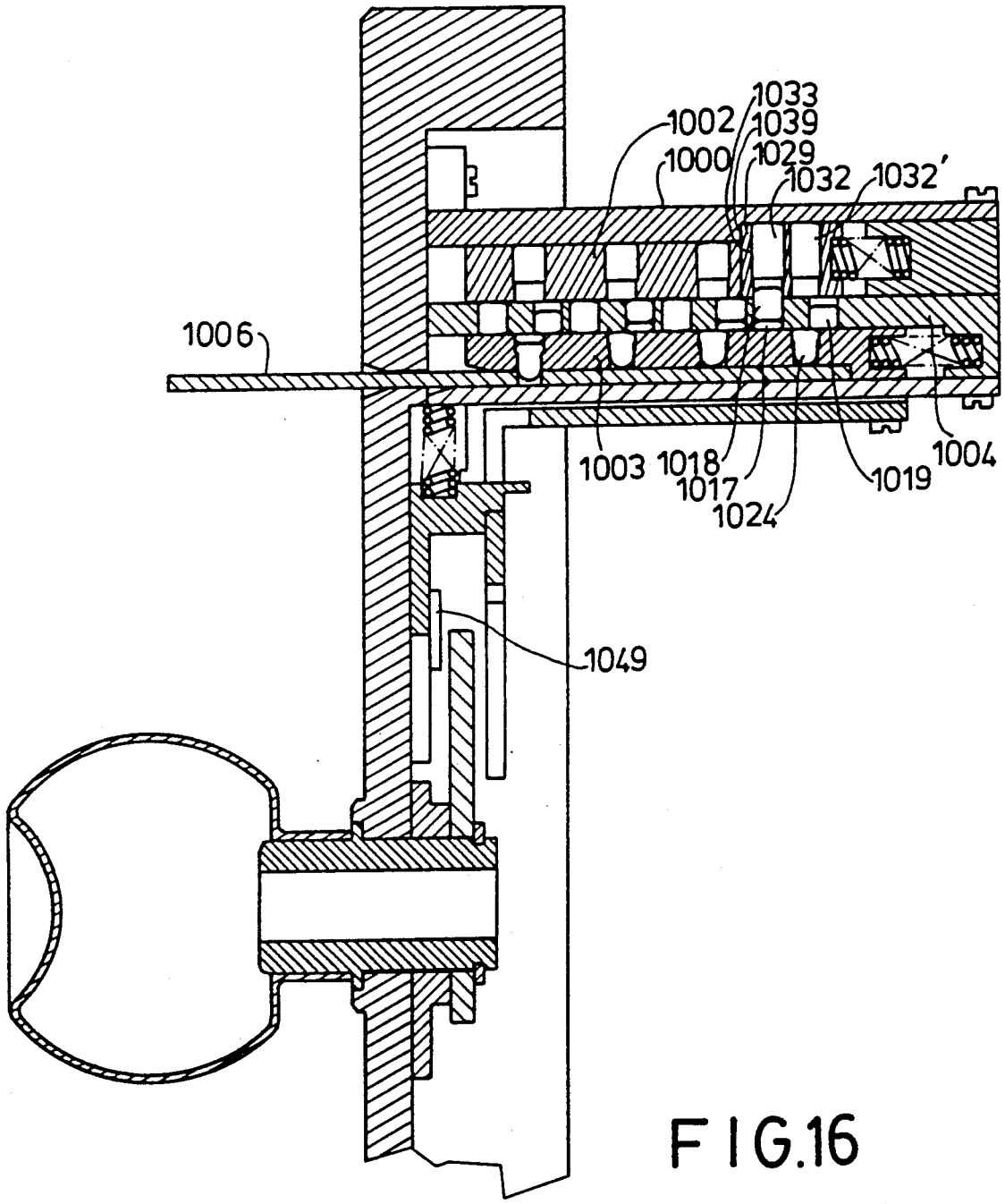
FIG. 16 shows the same section as FIG. 13 but with the bead seats being moved rearward by the operating key.

When a key card 1006 is inserted into the key bore as shown in FIG. 15, the upper and lower bead seats 1002 and 1003 are moved to their first rear position shown in FIG. 16, because their rearward movement is limited by the locking bead seat 1029 which is immobilized by intermediate tumbler beads 1018 provided at the rear part of the intermediate bead seat 1004. The immobilizing intermediate tumbler beads 1018 project into the bead holes 1032 of the locking bead seat 1029. In this situation, the rearward movement of the upper bead seat 1002 is limited by the locking bead seat 1029.

Figure 17:
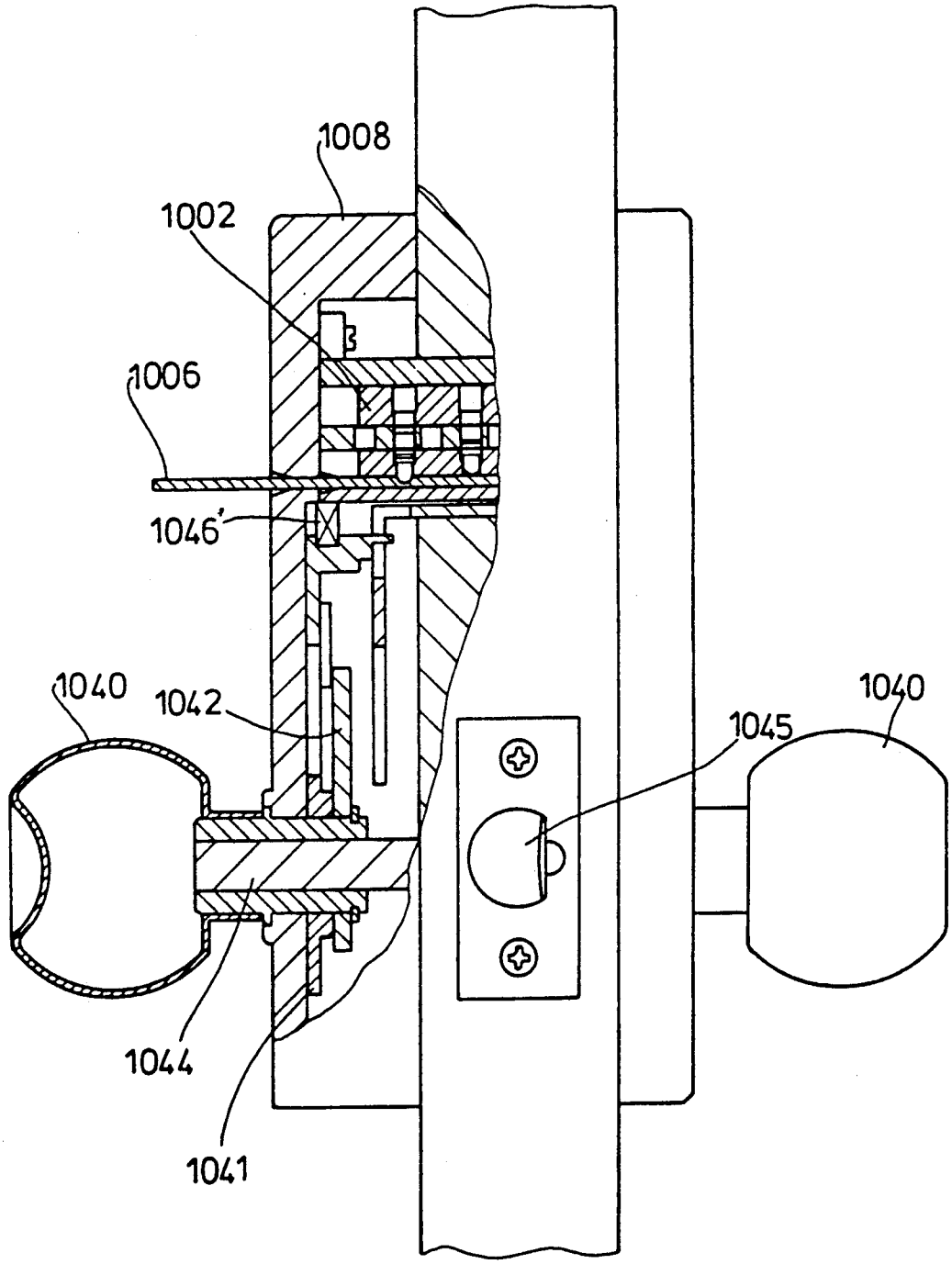
FIG. 17 shows the lock of FIG. 12 mounted on a door.

Referring again to FIG. 12 and 13 in combination with FIG. 17, two knobs 1040 are mounted to a bolt actuating shaft 1044 which in turn is mounted to the casing 1008. A rotary cam 1041 and a crank plate 1042 are mounted to the bolt actuating shaft 1044 near the front knob 1040. A bolt 1045 is connected to the bolt actuating shaft 1044. A U-shaped guide plate 1043 is mounted, in a vertically movable position, in a guide groove formed between the inner side of the wall of the casing 1008 and a plate 1049 secured to the casing 1008. A compression spring 1046 biases the guide plate 1043 downward. The L-shaped locking plate 1026 which is connected to the lower bead seat 1003 has a downward projecting part 1026' and a guide slot 1026''. The bottom of the downward projecting part 1026' is forked to engage the crank plate 1042 so as to prevent rotation of the shaft 1044.

The guide plate 1043 has a rearward projecting guide part 1046 extending into the hole 1026'' of the locking plate 1026 and abuts with the slotted edge of the locking plate by the spring 1046. The rear end of the guide plate 1043 is stepped to form two shoulders 1047 and 1048. The shoulder 1047 of the guide plate 1043 abuts the locking plate 1026 when the upper and lower bead seats are in their second rear position. The shoulder 1048 abuts the locking plate 1026 when the upper and lower bead seats are their first rear position.

The bottom face of the rearward projecting guide part 1046 of the guide plate 1043 normally abuts the locking plate 1026 and the downward projecting portion 1026' engages the crank plate 1043 when the lock is not operated. When the key card or the code card is used, the locking plate 1026 is moved rearward and automatically abuts the shoulder 1048 or 1047 because of the spring 1046, thereby being temporarily held in its rear position. In this situation, the crank plate 1042 is released from the locking plate 1026. The user may rotate the knob 1040 counterclockwise as shown in FIG. 12, thereby unlatching the door and turning the cam 1041 and the crank plate 1042 in the directions shown by arrows Y and X. As the cam 1041 is rotated, it cams the guide plate 1043 to rise, thereby raising the guide plate 1043 and permitting the locking plate 1026 to move forward. After the locking plate, the bottom face of the guide plate 1043 again abuts the locking plate 1026.

Figure 18:
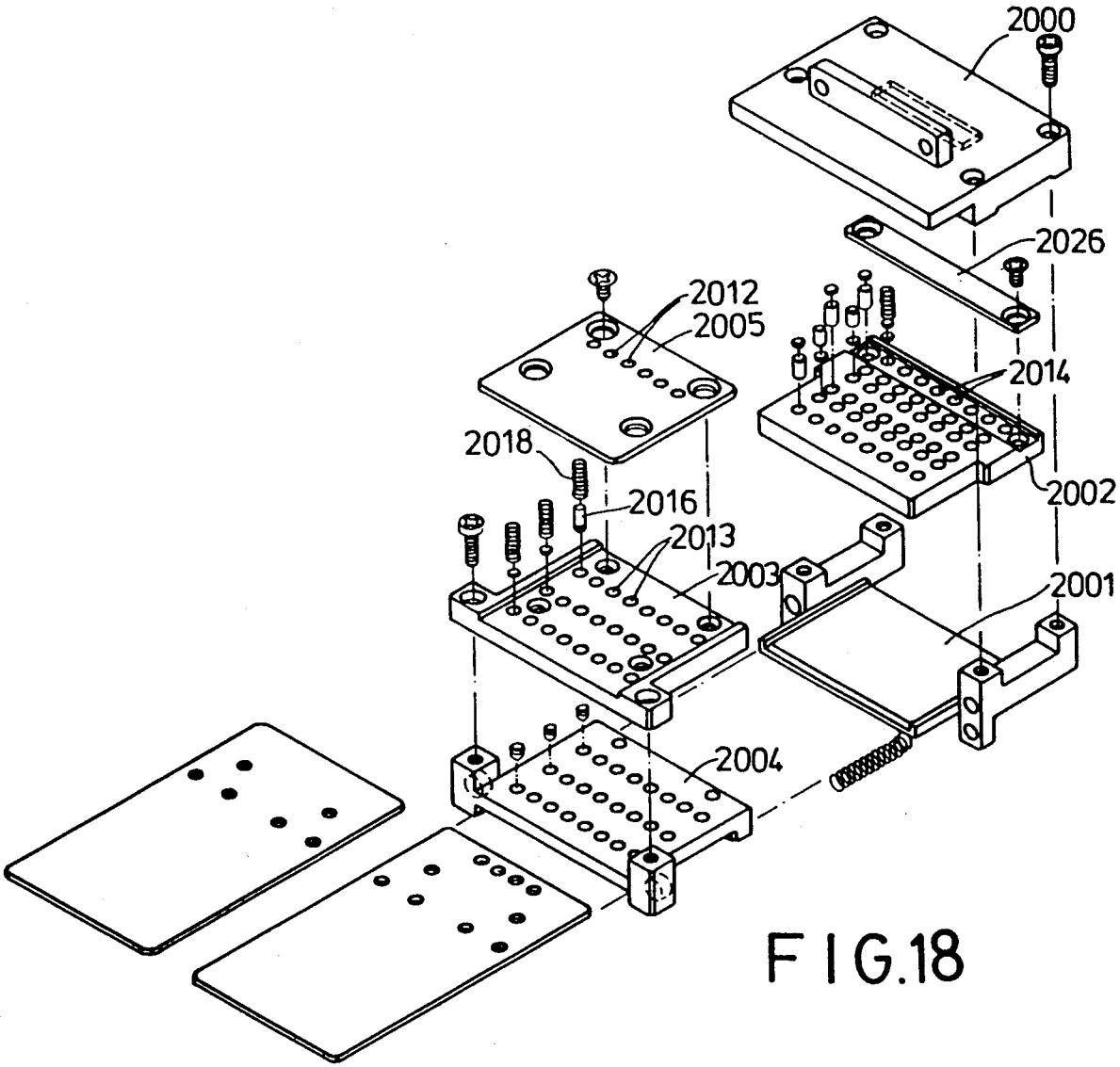
FIG. 18 is an exploded view of a third embodiment of the present invention.
Figure 19:
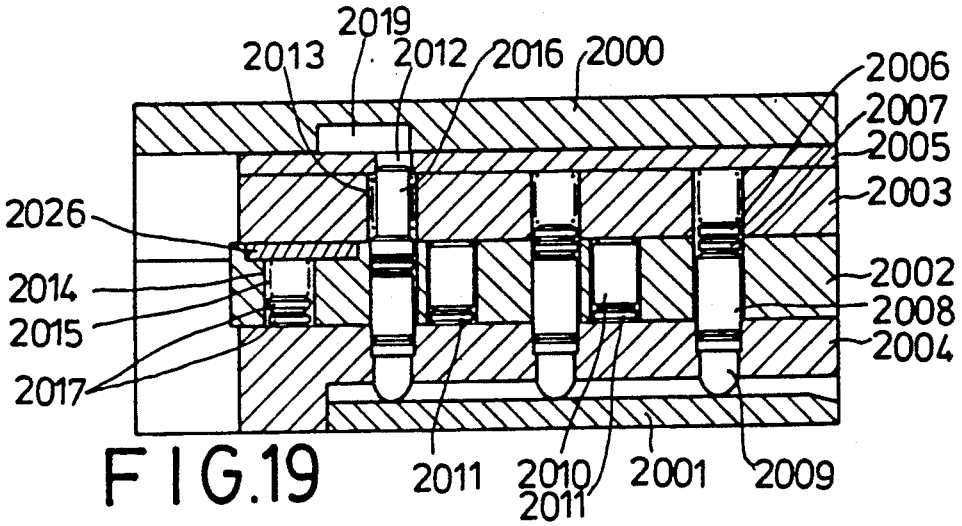
FIG. 19 is a sectional view of the lock of FIG. 18.

Referring to FIGS. 18 and 19, a third embodiment of the present invention is shown, having two holding plates 2000 and 2001 which are screwed to an intermediate bead seat 2002. An upper bead seat 2003 is disposed between the upper holding plate 2000 and the intermediate bead seat 2002. A lower bead seat 2004 is disposed between the lower holding plate 2001 and the intermediate bead seat 2002. The arrangement and the function of tumbler beads 2006, 2007, 2008, 2009, and 2010, and transfer beads 2011 are similar to those of the second embodiment. The third embodiment has a different means for preventing the upper and lower bead seats 2003 and 2004 from moving to their second rear position when a key card is used.

A seat cover plate 2005 is disposed above and screwed to the upper bead seat 2003. A row of holes 2012 provided in the seat cover plate 2005 are aligned with the rearmost row of bead holes 2013 of the upper bead seat 2003. A narrow seat cover plate 2026 is disposed above the recessed rear part of the intermediate bead seat 2002 to cover the rearmost row of bead holes 2014 of the intermediate bead seat 2002. The bead holes 2014 receive two tumbler beads 2017 and helical springs 2015. The helical springs 2015 are attached to the seat cover plate 2026 and bias the beads 2017 downward. The beads 2016 in the bead holes 2013 are in the form of flanged beads which are sleeved by helical springs 2018. The top ends of the beads 2016 can project outward through the smaller holes 2012 of the seat cover plate 2005. A groove 2019 is formed in the upper holding plate 2000 to receive the top ends of the beads 2016.

Figure 20:
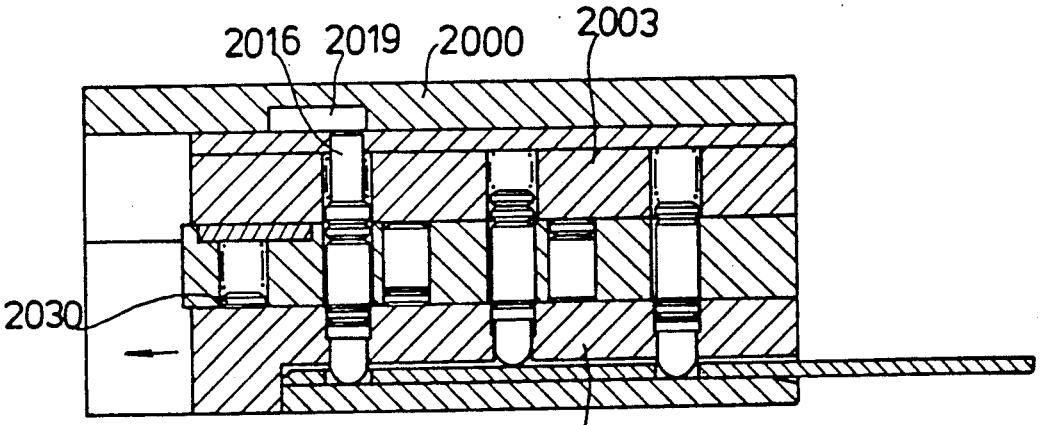
FIG. 20 shows the same section as FIG. 19 but with a code key inserted.
Figure 21:
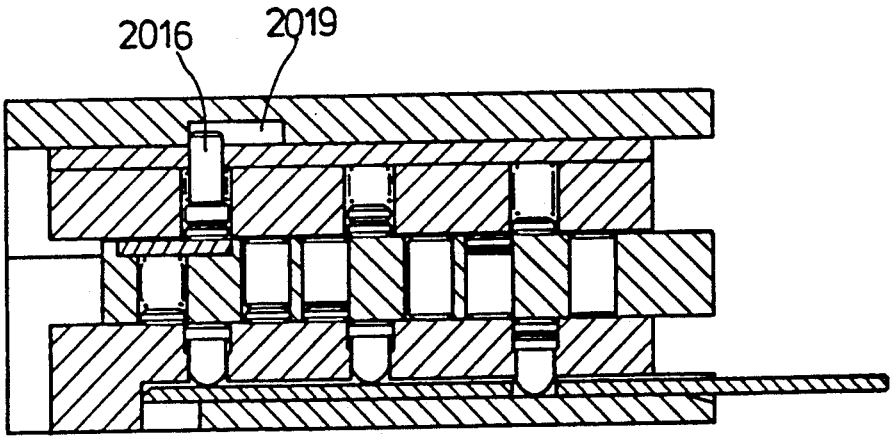
FIG. 21 shows the same section as FIG. 19 but with an operating key inserted.

Referring to FIG. 20, when a code card is inserted into the key bore of the lock, the beads 2016 do not project upward and thus the upper and lower bead seats 2003 and 2004 can be moved to the second rear position thereof. Referring to FIG. 21, when a key card is inserted into the key bore of the lock, the beads 2016 project into the groove 2019 so that the upper and lower bead seats 2003 and 2004 are limited to the first rear position thereof.

Figure 22:
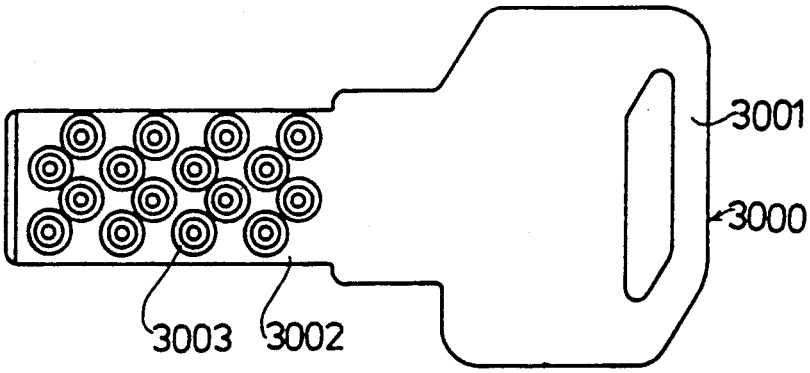
FIG. 22 is a plan view of a key that can be used with the lock of the invention.

The constructions of the code key and the operating key to be used with the lock of the present invention may be the code cards and the key cards which are provided with ready-made key holes or code holes as those described hereinbefore or those having a head and a perforable platelike portion, for instance, an operating key 3000 shown in FIG. 22. The perforable platelike portion is provided with seams bounding removable parts so that the user can choose his own combination of holes just by removing the removable parts from the platelike portion.

Figure 23:
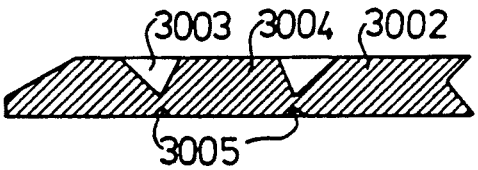
FIG. 23 is a sectional view of a perforable platelike portion of the key of FIG. 22.

Referring to FIG. 23 in combination with FIG. 22, the key 3000 has a head 3001 and a perforable platelike portion 3002 with pairs of upper and lower circular seams 3003 and 3004 bounding removable parts or scraps 3004. The circular seams 3003, 3004 are formed as grooves of V-shaped cross-section by a punching process. A desired combination of holes can be obtained in the platelike portion by striking some removable parts out of the platelike portion.

Figure 24:
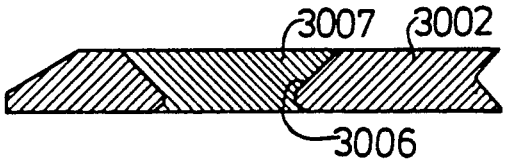
FIGS. 24 and 25 are sectional views of the perforable platelike portion of another key.
Figure 25:
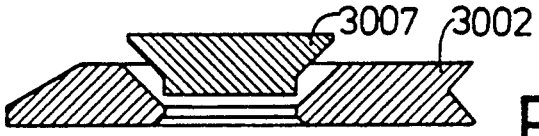

Referring to FIG. 24 and 25, the perforable platelike portion 3002 may be originally provided with pierced holes 3006. A filler material 3007 such as a plastic material is poured into the pierced holes 3006. The filler material can be removed from the platelike portion to form a combination of holes.

Figure 26:
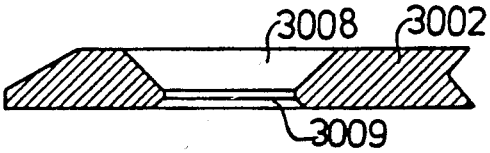
FIGS. 26, 27 & 28 are sectional views showing alternative holes formed in the platelike portion of the key of the invention.

Referring to FIG. 26, the holes which will be formed in the platelike portion 3002 have an upper portion 3008 which converged downward and a lower portion 3009 which is slightly diverged downward.

Figure 27:
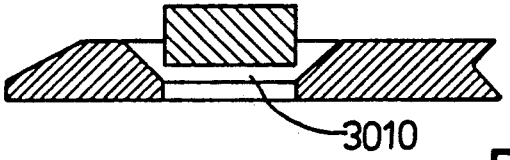
Figure 28:
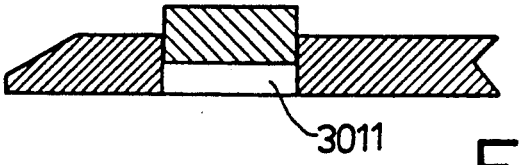

Alternatively, the platelike portion of the key may be provided with holes 3010 tapered downward without any lower diverging portion as shown in FIG. 27, or cylindrical holes 3011 shown in FIG. 28.

With the invention thus explained, it is apparent that various variation and modifications can be made without departing from the scope of the invention. It is therefore intended that the invention be limited only as indicated in the appended claims.

I claim:

1. A code lock which can be coded by a platelike code key, said code lock comprising:

a tabular intermediate bead seat having alternating first and second intermediate bead holes;

a tabular upper bead seat slideably lying above said intermediate bead seat and having upper bead holes;

a tabular lower bead seat slideably disposed beneath said intermediate bead seat and having lower bead holes;

a group of tumbler beads for locking and unlocking said upper and lower bead seats against movement relative to said intermediate bead seat, said group including upper tumbler beads provided in said upper bead holes, lower tumbler heads provided in said lower bead holes, first intermediate tumbler beads received in said first intermediate bead holes, second intermediate tumbler' beads received in said second intermediate bead holes, transfer beads originally received in said second intermediate bead holes below said first intermediate tumbler beads;

said upper and lower bead seats being associated to simultaneously move between a normal position in which said first intermediate bead holes are aligned with said upper and lower bead holes, and a resetting position in which said second intermediate bead holes are aligned with said upper and lower bead holes, said upper and lower tumbler beads, said first intermediate tumbler being put into a combination by selectively transferring said transfer beads from respective said second intermediate bead holes to respective said first intermediate bead holes, said transfer beads being selectively discharged from said second intermediate bead holes into said lower bead holes by means of said code platelike key when said upper and lower bead seats are in said resetting position, said transfer beads discharged thereby being moved to said first intermediate bead holes when said upper and lower bead seats are moved to said normal position.

2. A code lock comprising:

a platelike perforated operating key;

a platelike perforated code key;

a casing having a key bore, and a front and rear end;

a tabular intermediate bead seat extending from said front and rear ends and having alternating first and second intermediate bead holes;

a tabular upper bead seat slideably lying above said intermediate bead seat and having upper bead holes;

a tabular lower bead seat slideably disposed beneath said intermediate bead seat and above said key bore, said tabular lower bead having lower bead holes;

a first group of tumbler beads for locking and unlocking said upper and lower bead seats against movement relative to said intermediate bead seat, said first group including upper tumbler beads provided in said upper bead holes, lower tumbler heads provided in said lower bead holes, first intermediate tumbler beads received in said first intermediate bead holes, second intermediate tumbler beads received in said second intermediate bead holes, transfer beads originally received in said second intermediate bead holes below said first intermediate tumbler beads;

means for urging said upper and lower bead seats to a forward position, said upper and lower bead seats being movable reward by said operating key to a first rear position and by said code key to a second rear position rearwardly of said first rear position, said upper and lower bead holes being aligned with said second intermediate bead holes when said upper and lower bead seats are in said second rear position, said upper and lower bead holes being aligned with said first intermediate bead holes when said upper and lower bead seats are in said forward position, said upper and lower tumbler beads, said first intermediate tumbler being put into a combination by selectively transferring said transfer beads from respective said second intermediate bead holes to respective said first intermediate bead holes, said transfer beads being selectively discharged from said second intermediate bead holes into said lower bead holes by means of said code key when said upper and lower bead seats are in said second rear position, said transfer beads discharged thereby being moved to said first intermediate bead holes when said upper and lower bead seats are moved to said forward position;

said upper and lower bead seats being moved to said first rear position when said operating key is used, means for preventing said upper and lower bead seats from moving to said second rear position when said operating key is used.

3. A code lock as claimed in claim 2, wherein the length of said first intermediate tumbler beads is equal to that of said first intermediate bead holes, the length of each of said second intermediate bead holes is equal to the sum of the lengths of each of said second intermediate tumbler beads and each of said transfer beads.

4. A code lock as claimed in claim 3, wherein said upper tumbler beads are normally biased downward, said lower tumbler beads normally project into said operating key, said upper and lower bead seats being locked against movement relative to said intermediate bead seat when said second intermediate tumbler beads projecting into said upper or lower bead holes.

5. A code lock as claimed in claim 4, wherein said operating key has key holes arranged in a particular pattern, and said code key has code holes arranged in a pattern corresponding to said key holes and non-code holes.

6. A code lock as claimed in claim 5, further comprising a cylindrical housing having a cylindrical bore, a bolt actuating rod provided at a rear end of said cylindrical housing, said casing being cylindrical and rotatably inserted in said cylindrical bore, said intermediate bead seat further having a front and rear circular disks covering said front and rear ends of said casing, said rear circular disk being connected to said bolt actuating rod, said front circular disk having a key hole, said code lock further including a cylindrical body fitted in said casing, said cylindrical body having two tabular and parallel upper and lower grooves extending axially and chordally, said parallel upper and lower grooves dividing said cylindrical body into an upper plate-like part, an intermediate plate-like part and a lower plate-like part, said upper plate-like part forming said upper bead seat, said intermediate plate-like part forming said lower bead seat, said intermediate bead seat being received in said upper groove, said lower groove forming a key bore to be aligned with said key hole, said cylindrical body having an axial length smaller than that of said intermediate bead seat and being slidable relative to said intermediate bead seat.

7. A code lock as claimed in claim 6, wherein said urging means includes a compression spring disposed between said cylindrical body and said rear circular disk.

8. A code lock as claimed in claim 7, further comprising means for locking said cylindrical body against rotation, said means having an axial groove formed in an inner periphery of said cylindrical housing and a projection formed on said cylindrical body and extending into said axial groove of said cylindrical housing when said upper and lower bead seats are in said forward position, said projection being released from said axial groove when said upper and lower bead seats are in said first and second rear positions.

9. A code lock as claimed in claim 8, wherein said means for preventing said upper and lower bead seats from moving to said second rear position, including a second group of tumbler beads disposed in said upper and lower bead seats and said intermediate bead seat, said second group allowing said upper and lower bead seat to move to said second rear position in response to said non-code holes of said code key, said second group having at least one tumbler bead to engage said intermediate bead seat when said operating key is used, said intermediate bead seat being provided with a shallow and oblong recess to permit a limited rearward movement of said tumbler bead of said second group which in turn permits said upper and lower bead seats to move to said first rear position.

10. A code lock as claimed in claim 5, wherein said said first and second tumbler beads are biased downward by said upper beads by magnetic expulsion forces.

11. A code lock as claimed in claim 10, wherein said means for preventing said upper and lower bead seats from moving to said second rear position, includes a locking bead seat posterior to said upper bead seat and above said intermediate bead seat, and biased forward independently of said upper bead seat to a third position, and a third group of tumbler beads cooperative with said non-code holes of said code key and provided in said locking bead seat, in a rear part of said intermediate bead seat and in a rear part of said lower bead seat, said third group permitting said upper and lower bead seats to move to said second rear position when said code key is used, said third group immobilizing said locking bead seat in said third position to limit rearward movement of said upper bead seat when said operating key is used.

12. A code lock as claimed in claim 11, wherein said casing includes upper and lower holding plates extending between said front and rear ends of said casing and sandwiching said upper and lower bead seats, said intermediate bead seat and said locking bead seat, said holding plates being screwed to said intermediate bead seat, said key bore being formed between said lower bead seat and said lower holding plate.

13. A code lock as claimed in claim 12, further comprising a locking plate of L-shape disposed below said lower holding plate and secured to said lower bead seat for simultaneous movement therewith, said locking plate having a front end with a portion projecting downward, a bolt actuating shaft mounted to said casing below said locking plate, a rotary knob mounted on said bolt actuating shaft adjacent to said front end of said casing, and means for releasably engaging said downward projecting portion of said locking plate and said bolt actuating shaft, said releasably engaging means disengaging said downward projecting portion from said bolt actuating shaft when said locking plate is moved rearward by said lower bead seat.

14. A code lock as claimed in claim 13, wherein said realizable engaging means includes a crank plate mounted to said bolt actuating shaft, said downward projecting portion having a forked bottom end to engage said crank plate.

15. A code lock as claimed in claim 14, further includes a guide plate provided in front of said downward projecting portion of said locking plate and above said bolt actuating shaft in a vertically movable position, said guide plate having a rearward projecting guide part, said locking plate further having a guide slot above said forked bottom end, said rearward projecting guide part extending into said guide slot, said guide plate being biased downward to cause said rearward projecting guide part to abut with said downward projecting portion.

16. A code lock as claimed in claim 15, wherein said rearward projecting guide part has a rear end stepped to form a first shoulder and a second shoulder, said first shoulder abutting and temporarily retaining said downward projecting portion when said upper and lower bead seats are moved to said first rear position, said second shoulder abutting and temporarily retaining said downward projecting portion when said upper and lower bead seats are in said second rear position.

17. A code lock as claimed in claim 16, further comprising a rotary cam mounted to said bolt actuating shaft in front of said crank plate, said guide plate camming said guide plate to rise so as to permit said locking plate to move forward.

18. A code lock as claimed in claim 12, wherein said means for preventing said upper and lower lower bead seats from moving to said second rear position, including a fourth group of tumbler beads provided in the rear parts of said upper and lower bead seats and the rear part of said intermediate bead seat, said fourth group including a tumbler bead to project upwardly and outwardly of said upper bead seat when said operating key is used, said upper holding plate having a shallow and oblong recess to partially receive said tumbler bead of said fourth group so as to permit it to make a limited rearward movement.

* * * * *

UNITED STATES PATENT AND TRADEMARK OFFICE

CERTIFICATE OF CORRECTION

PATENT NO. : 5,103,661

DATED : April 14, 1992

INVENTOR(S) : Fann

It is certified that error appears in the above-indentified patent and that said Letters Patent is hereby corrected as shown below:

```
Col. 1, lines 33 & 35:  Change "slideably" to --slidably--;
        line 41:  Change "heads" to --beads--;
        line 46:  Change "first" to --second--;
Col 2, line 20:   Delete "with";

Col. 3, line 2:   Change "tabular" (second occurence)
                  to --axial--;

        line 4:   After "body " insert --3--;
        line 11:  Change "2" to --3--;
        line 12:  Change "3" to --2--;
        line 38:  Before "body," insert --non-slidable--;
        line 39:  Change "4" (first occurrance) to --A--;
        line 41:  Change "Figure 3 to --Figure 2--;
        line 43:  After "body," insert --3--;
        line 44:  Change "casing" to --housing--;
Col. 4, line 1:   Change "3" to --2--;
        line 9:   Change "second" to --first--;
        line 26:  Change "35" to --36--;
        line 37:  Change "3" to --2--;
        line 48:  After " 6' ",  insert --(Figure 9)--, and
                  add --further--   after "cannot be";
        line 58:  Change "2" to --3--;
        line 62:  Change "361'" to 361, and insert --3--
                  after "body";
```

UNITED STATES PATENT AND TRADEMARK OFFICE

CERTIFICATE OF CORRECTION

PATENT NO. : 5,103,661

DATED : April 14, 1992

INVENTOR(S) : Fann

It is certified that error appears in the above-indentified patent and that said Letters Patent is hereby corrected as shown below:

Col. 5, lines 23-24: Delete "378". After "1022.", insert --The spring holes are not clearly visible in Figure 12, but extend within the downward flange of bead seat 1004 in a direction parallel to the axis of springs 1022.-- line 35: Change "50" to --1022--;

line 44: Change "1002" to --1004--;

line 52: Change "1034" to --1035--;

Change "1035" to --1034--;

Col. 6, line 22: Change "1032" to --1033--;

line 35: Change "1046" to --1046'-- line 45: Change "1046" to --1046'--;

line 51: After "are," insert --in--;

line 55: After "1026," insert --(Figure 15)--;

line 59: Change "1046" to --1046'--;

line 68: After "plate" insert --1026 is moved forward--;

Col. 7, line 57: Change "3004" to --3005--;

line 58: Change "3004" (second occurrence) to --3005--

UNITED STATES PATENT AND TRADEMARK OFFICE

CERTIFICATE OF CORRECTION

PATENT NO. :5,103,661

DATED :April 14, 1992

INVENTOR(S) :Fann

It is certified that error appears in the above-indentified patent and that said Letters Patent is hereby corrected as shown below:

```
Col. 8, line 19:     Change "slideably" to --slidably--;
        line 29: Change "heads" to --beads--
        line 35: Change "first" to --second--;
        line 45:                Insert --beads-- after
                                "tumbler";
        line 64:                Change "slideably" to
                                --slidably--.
        line 67: Change "slideably" to --slidably--;
Col. 9, line 1: After "bead" (first occurrence), insert
                --seat--;
        line 7:                 Change "heads" to --beads--;
        line 13:                Change "first" to --second--;

        line 56: Change "second" to --first--;
Col. 10, line 50:Delete "said";
Col.12, line 17: Change "guide plate" to --rotary cam--;
        line 21: Delete "lower" (second occurrence).
```

Signed and Sealed this

Twenty-eighth Day of September, 1993

Bruce Lehman

*Attest:*

BRUCE LEHMAN

*Attesting Officer*

*Commissioner of Patents and Trademarks*